US007597210B2

(12) United States Patent
Lin

(10) Patent No.: US 7,597,210 B2
(45) Date of Patent: Oct. 6, 2009

(54) GARBAGE-CONTAINING APPARATUS

(76) Inventor: Tsong-Yow Lin, No. 57-1, Yung Ho Street, Yung Ho Village, Ta Tu Hsiang, Taichung Hsien (TW)

( * ) Notice: Subject to any disclaimer, the term of this patent is extended or adjusted under 35 U.S.C. 154(b) by 345 days.

(21) Appl. No.: 11/419,815

(22) Filed: May 23, 2006

(65) Prior Publication Data

US 2007/0241109 A1 Oct. 18, 2007

(30) Foreign Application Priority Data

Apr. 4, 2006 (TW) ..... 95112064 A

(51) Int. Cl.
*B65D 43/26* (2006.01)

(52) U.S. Cl. ..... 220/262; 220/263; 220/908; 220/828

(58) Field of Classification Search ..... 220/262, 220/263, 264, 827, 908, 828
See application file for complete search history.

(56) References Cited

U.S. PATENT DOCUMENTS 2,325,897 A * 8/1943 Waltman ..... 220/264
2,663,529 A * 12/1953 Lyttaker ..... 248/147
3,825,215 A * 7/1974 Borglum ..... 248/147
5,084,939 A * 2/1992 Garman ..... 16/84
6,010,024 A * 1/2000 Wang ..... 220/23.87
6,024,238 A * 2/2000 Jaros ..... 220/264
6,209,744 B1 * 4/2001 Gill ..... 220/263
6,837,393 B1 * 1/2005 Kuo ..... 220/263
6,883,676 B2 * 4/2005 Lin ..... 220/263
6,920,994 B2 * 7/2005 Lin ..... 220/264
7,033,039 B2 * 4/2006 Lin ..... 362/154
7,077,283 B2 * 7/2006 Yang et al. ..... 220/262
7,225,943 B2 * 6/2007 Yang et al. ..... 220/263
7,374,060 B2 * 5/2008 Yang et al. ..... 220/263
2002/0079315 A1 * 6/2002 Yang ..... 220/263
2003/0201267 A1 * 10/2003 Yang et al. ..... 220/263
2003/0201268 A1 * 10/2003 Lin ..... 220/263
2004/0016756 A1 * 1/2004 Lin ..... 220/263
2005/0017006 A1 * 1/2005 Kuo ..... 220/263
2005/0103788 A1 * 5/2005 Yang et al. ..... 220/263

OTHER PUBLICATIONS

Taiwanese Patent M240434, Aug. 11, 2004, 10 pages.

* cited by examiner

*Primary Examiner*—Anthony D Stashick
*Assistant Examiner*—Christopher B McKinley
(74) *Attorney, Agent, or Firm*—Alan Kamrath; Kamrath & Associates PA

(57) ABSTRACT

A garbage-containing apparatus includes a base, a bin installed on the base, a cover installed on the bin, a pedal installed on the bin or the base, a linking device for linking the pedal to the cover and a buffering device provided between the linking device and the bin. The buffering device buffers the cover through the linking device in a lowering stroke of the cover.

14 Claims, 9 Drawing Sheets

GARBAGE-CONTAINING APPARATUS

BACKGROUND OF INVENTION

1. Field of Invention

The present invention relates to garbage bin and, more particularly, to a garbage-containing apparatus that includes an internal bin for containing garbage, an external bin for decoratively concealing the internal bin, a cover for closing the internal and external bins and a buffer for buffering the cover in a lowering stroke.

2. Related Prior Art

There are various garbage-containing apparatuses. Some of the garbage-containing apparatuses are simple plastic garbage bins. Such a plastic garbage bin is generally used at an average home. Some other of the garbage-containing apparatuses each include a internal bin for containing garbage, a external bin for decoratively concealing the plastic internal bin and a cover for covering the plastic internal bin and the metal external bin. The internal bin is made of plastic in consideration of cost. The external bin is made of metal for the purposes of decoration. The cover is also made of metal for the purposes of decoration. Such a garbage-containing apparatus that includes two bins is generally used in a hotel. However, such a garbage-containing apparatus must be carefully maneuvered lest the metal cover would bump the metal external bin and make large noises that are intolerable in a tranquil hotel.

Disclosed in Taiwanese Patent M240434 is a garbage-containing apparatus including a plastic bin 20 for containing garbage, a metal bin 1 for decoratively concealing the plastic bin 20, two covers 4 for closing the metal bin 1, a pedal 14 and a rod 2 for linking the pedal 14 to the covers 4. As the pedal 14 is trodden, the covers 4 are lifted. When the pedal 14 is released, the covers 4 are lowered. A cushion 5 is used to cushion the lowering stroke of the covers 4. The cushion 5 is a hydraulic or air cylinder provided between the rod 2 and a bracket 16 secured to the internal side of the metal bin 1. The hydraulic or air cylinder 5 is, however, heavy, bulky, complicated and expensive. Moreover, the hydraulic or air cylinder 5 requires careful maneuvering and intense maintenance, or it will soon be damaged.

The present invention is therefore intended to obviate or at least alleviate the problems encountered in the prior art.

SUMMARY OF INVENTION

According to the present invention, a garbage-containing apparatus includes a base, a bin installed on the base, a cover installed on the bin, a pedal installed on the bin or the base, a linking device for linking the pedal to the cover and a buffering device provided between the linking device and the bin for buffering the cover through the linking device in a lowering stroke of the cover.

An advantage of the garbage-containing apparatus of the present invention is its light total weight, since the buffer adds only a little weight to the total weight.

Another advantage of the garbage-containing apparatus of the present invention is its low total cost, since the buffer adds only a little cost to the total cost, and it requires little reengineering to incorporate the buffer.

Another advantage of the garbage-containing apparatus of the present invention is its simple structure.

Another advantage of the garbage-containing apparatus of the present invention is durability.

Another advantage of the garbage-containing apparatus of the present invention is its low cost in use for not requiring intense maintenance.

Other advantages and features of the present invention will become apparent from the following description referring to the drawings.

BRIEF DESCRIPTION OF DRAWINGS

The present invention will be described through detailed illustration of two embodiments referring to the drawings.

DETAILED DESCRIPTION OF EMBODIMENTS

Figure 1:
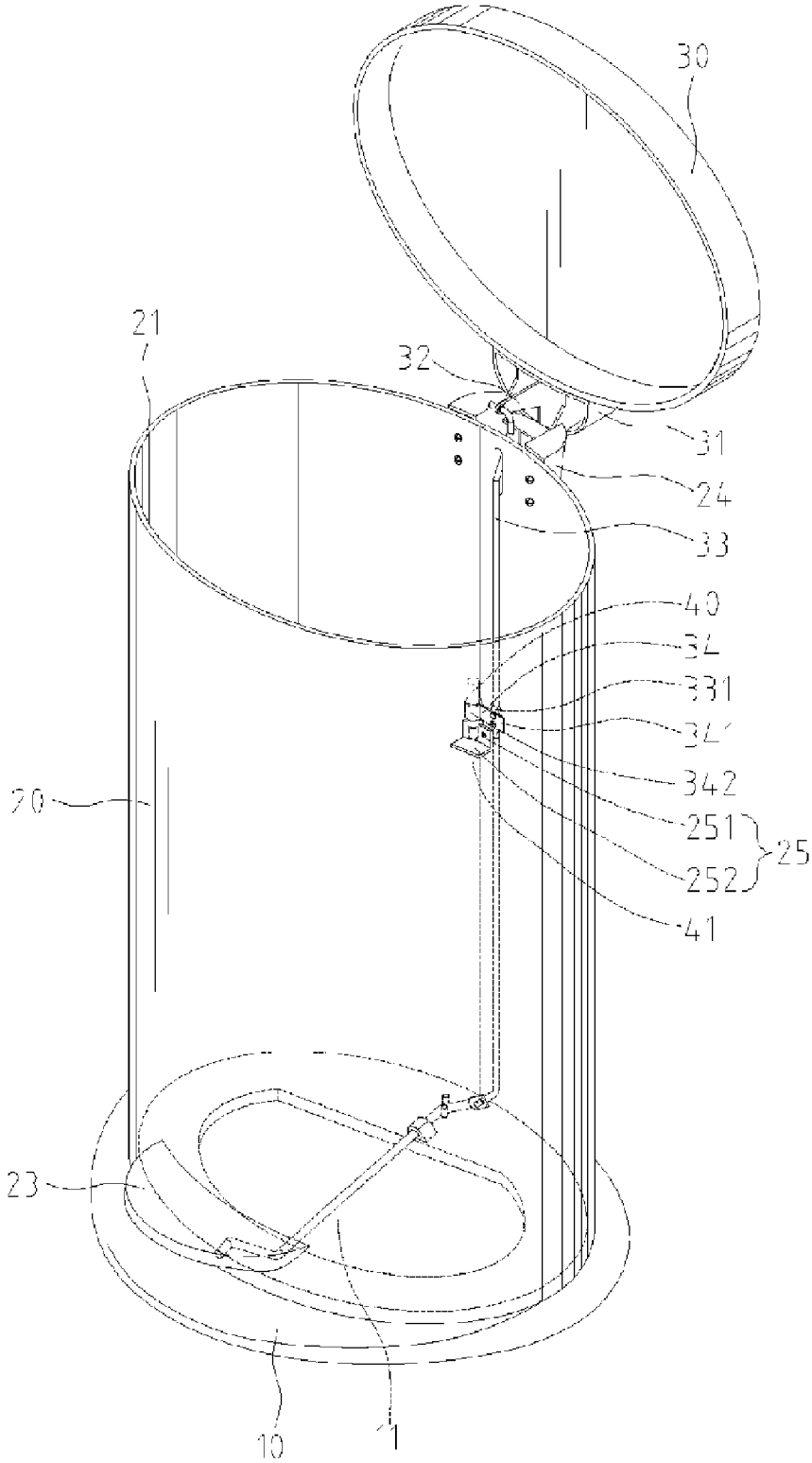
FIG. 1 is a perspective view of garbage-containing apparatus according to the first embodiment of the present invention.
Figure 2:
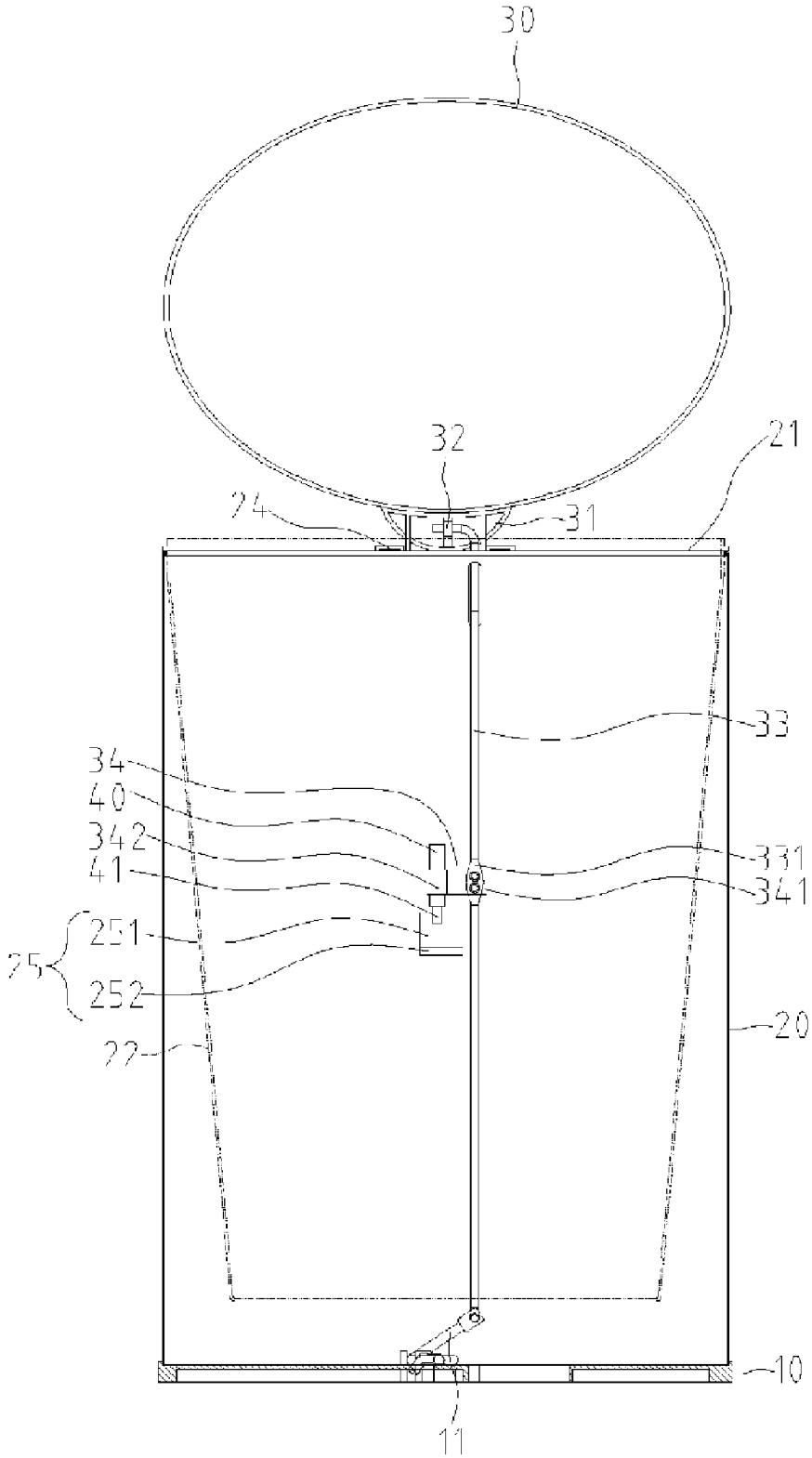
FIG. 2 is a cross-sectional view of the garbage-containing apparatus shown in FIG. 1.

Shown in FIGS. 1 and 2 is a garbage-containing apparatus according to a first embodiment of the present invention.

The garbage-containing apparatus includes a base 10 for installation on the ground or a floor, a plastic bin 22 for containing garbage, a metal bin 20 for decoratively concealing the plastic bin 22, a metal cover 30 for covering the metal bin 20 and the plastic bin 22, a pedal 23 installed on the metal bin 20 or the base 10 and a linking device for linking the pedal 23 to the metal cover 30. The metal bin 20 defines an opening 21. As the pedal 23 is trodden, the metal cover 30 is lifted. As the pedal 23 is released, the metal cover 30 is lowered. The garbage-containing apparatus includes a buffering device for buffering the metal cover 30 during the lowering stroke.

The linking device includes a crank shaft 11 and a rod 33. The crank shaft 11 is positioned horizontally. The crank shaft 11 includes a first crank at an end and a second crank at an opposite end. The first crank is connected to the pedal 23.

The rod 33 is positioned vertically. The rod 33 includes a lower end, an upper end and a flat middle section 331 between the ends. The lower end of the rod 33 is connected to the second crank.

The cover 30 includes a lug 31 pivotally connected to a lug 24 installed on the metal bin 20. The cover 30 includes an extension 32 extended from the lug 31. The extension 32 is connected to the upper end of the rod 33.

The buffering device includes a mount 34 secured to the rod 33, a buffer 40 secured to the mount 34 and a bracket 25 for contact with the buffer 40 during the lowering stroke of the cover 30.

The bracket 25 includes a vertical section 251 secured to the internal side of the metal bin 20 by welding or fasteners such as rivets and threaded bolts.

The mount 34 includes a flat end 341 and a looped end 342. The flat end 341 of the mount 34 is connected to the flat middle section 331 by welding or fasteners such as rivets and threaded bolts.

The buffer 40 is fit in the looped end 342 of the mount 34. The buffer 40 includes a tongue 41 extended from the interior thereof to the exterior. The tongue 41 comes into contact with the horizontal section 252 of the bracket 25 during the lowering stroke of the cover 30. The buffer 40 is an inexpensive element that is often used in interior decoration. Preferably, the buffer 40 is a so-called German buffer.

Figure 3:
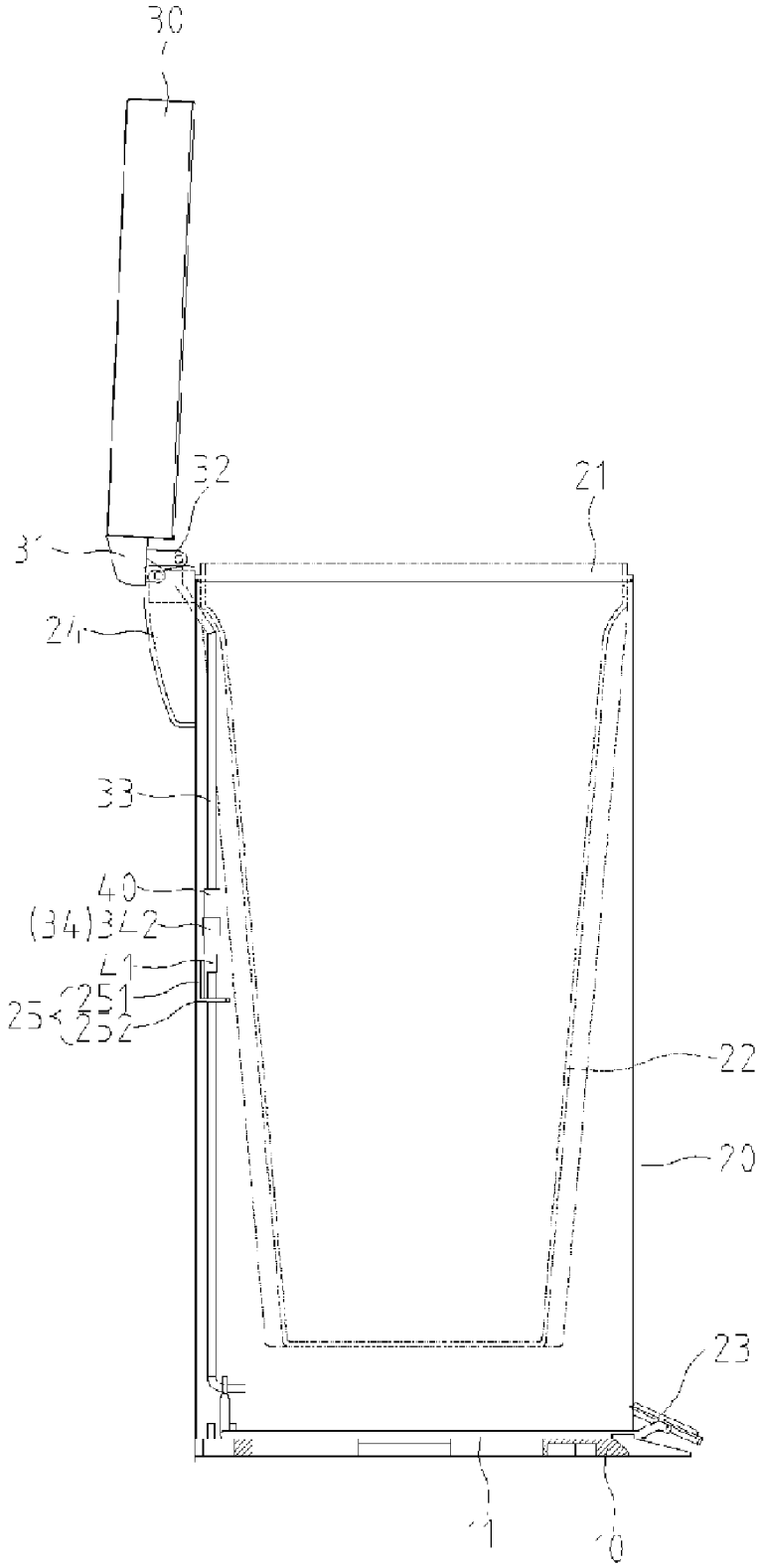
FIG. 3 is another cross-sectional view of the garbage-containing apparatus shown in FIG. 2.

Referring to FIG. 3, the pedal 23 is trodden so that the crank shaft 11 is rotated. The rod 33 is lifted and so is the cover 30. The buffer 40 is removed from the horizontal section 252 of the bracket 25. The tongue 41 of the buffer 40 is extended.

Figure 4:
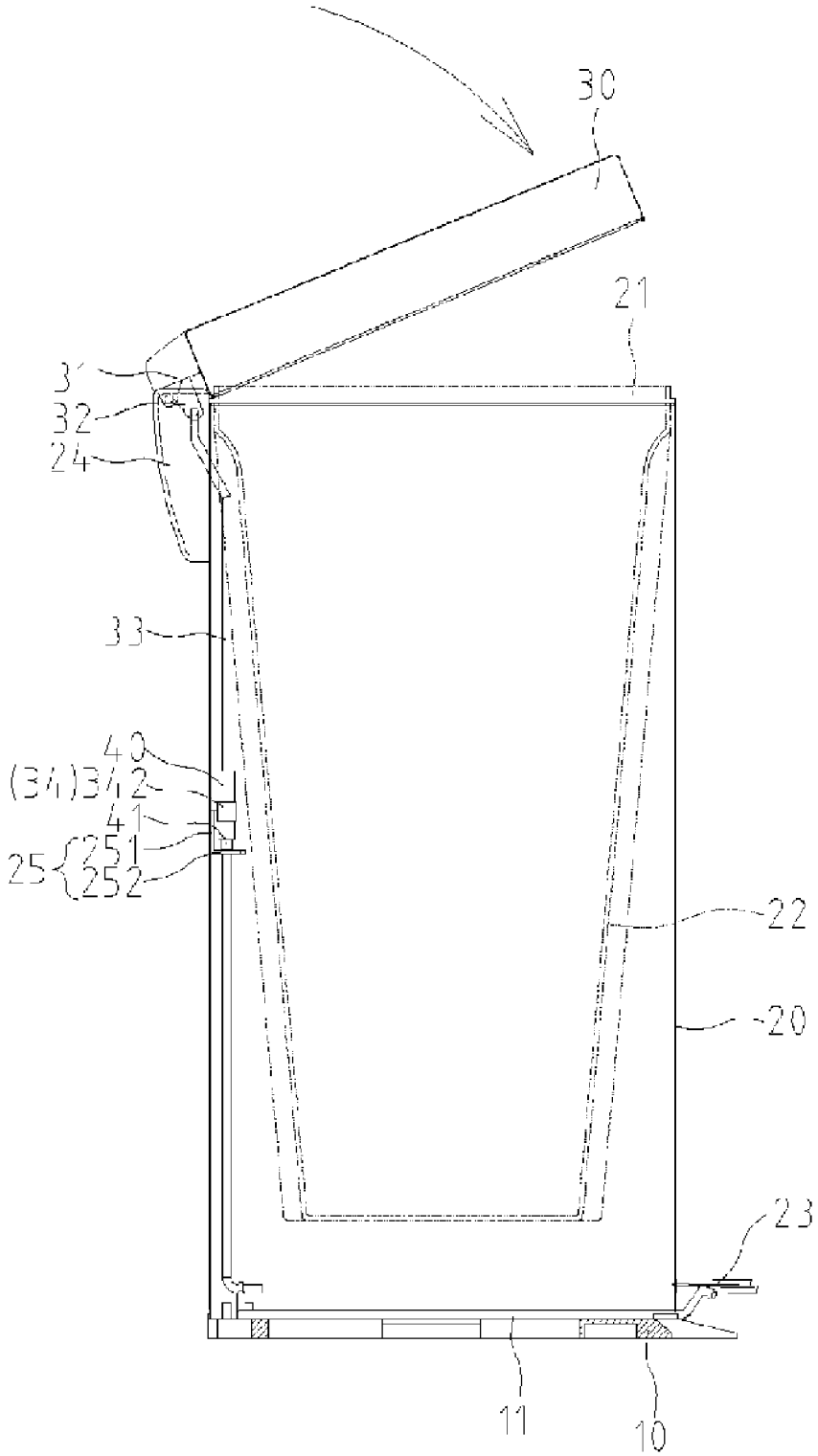
FIG. 4 is a cross-sectional view of the garbage-containing apparatus in another position than shown in FIG. 3.
Figure 5:
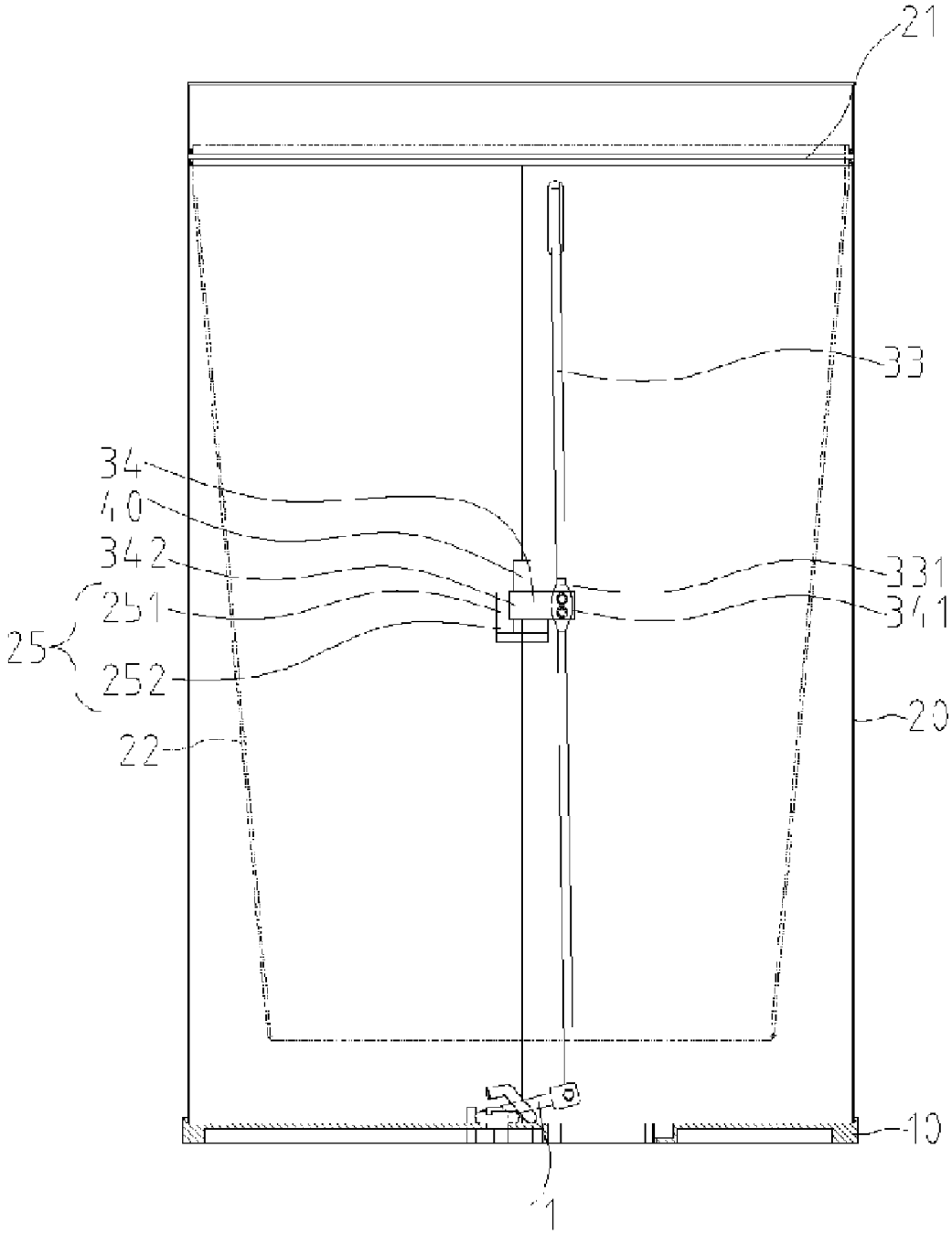
FIG. 5 is a cross-sectional view of the garbage-containing apparatus in another position than shown in FIG. 2.
Figure 6:
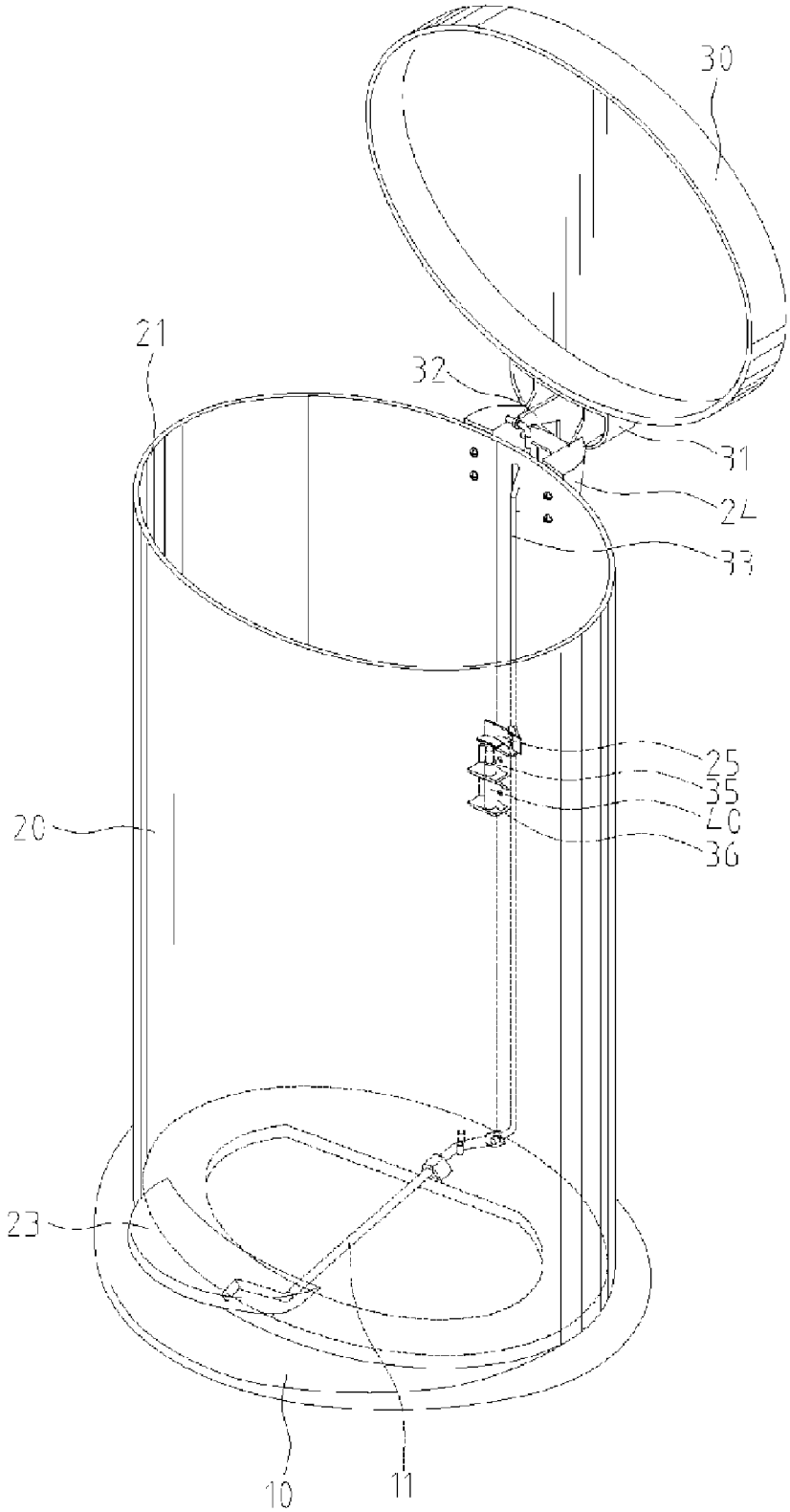
FIG. 6 is a perspective view of garbage-containing apparatus according to the second embodiment of the present invention.
Figure 7:
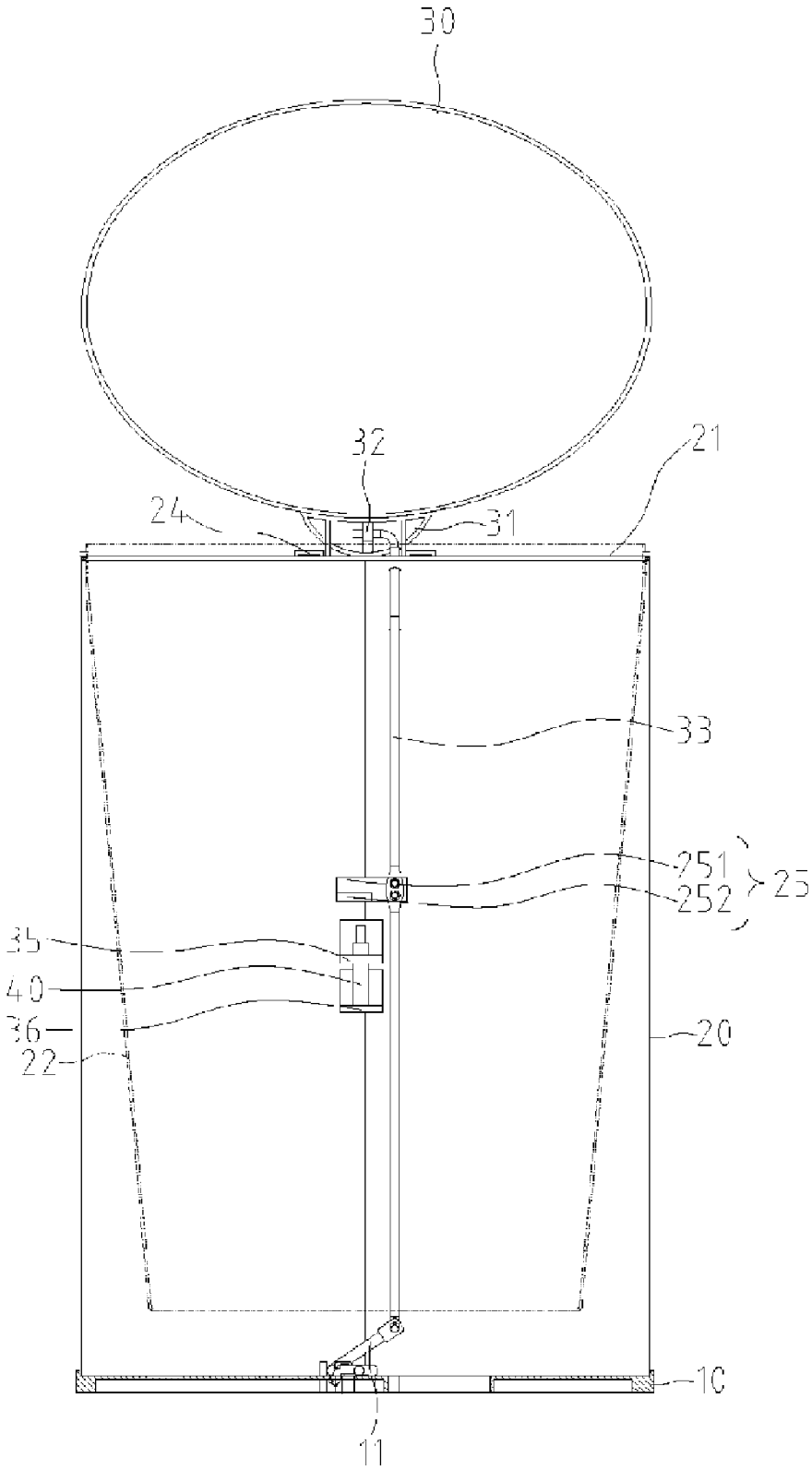
FIG. 7 is a cross-sectional view of the garbage-containing apparatus shown in FIG. 6.
Figure 8:
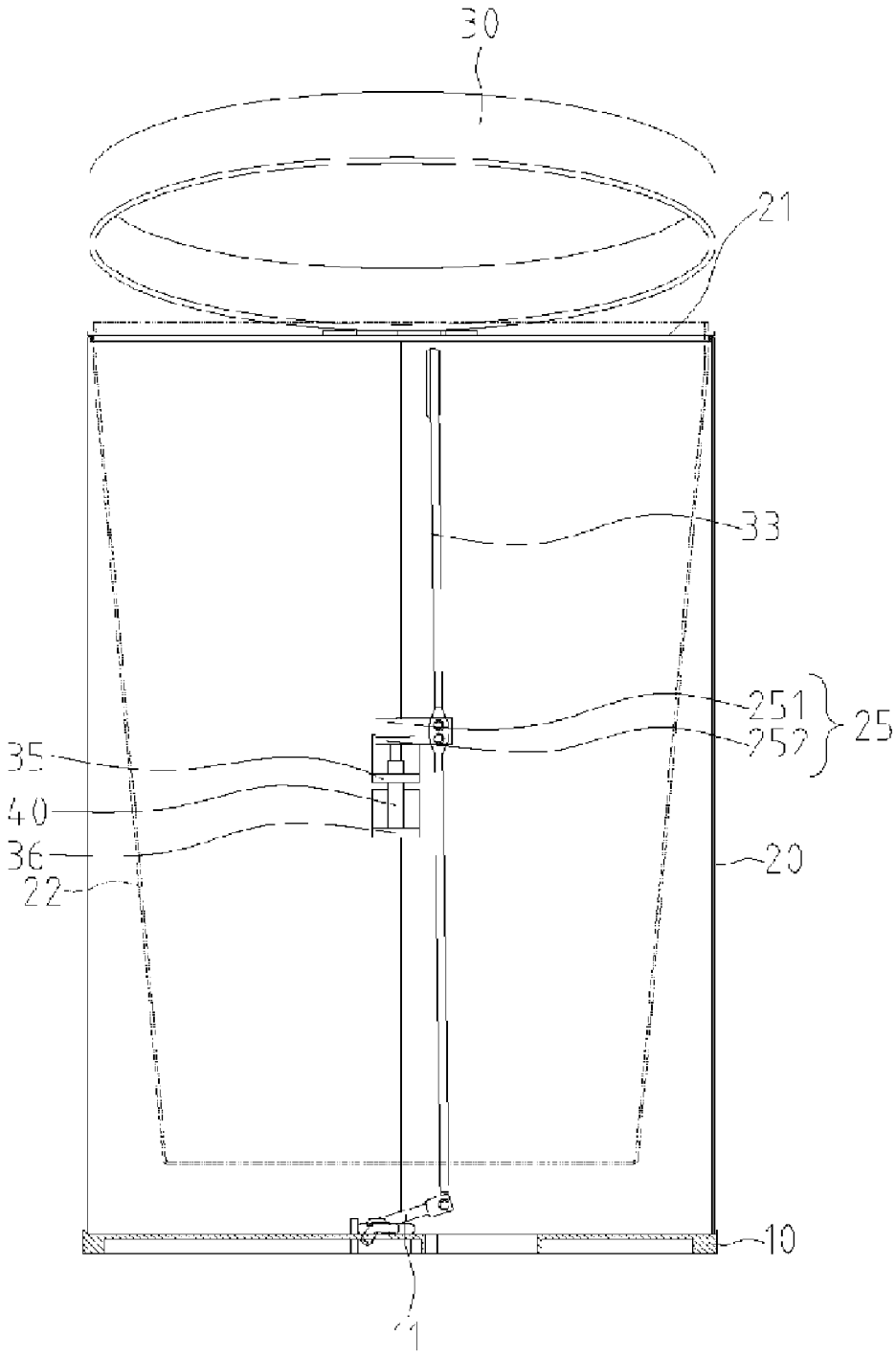
FIG. 8 is a cross-sectional view of the garbage-containing apparatus in another position than shown in FIG. 7.
Figure 9:
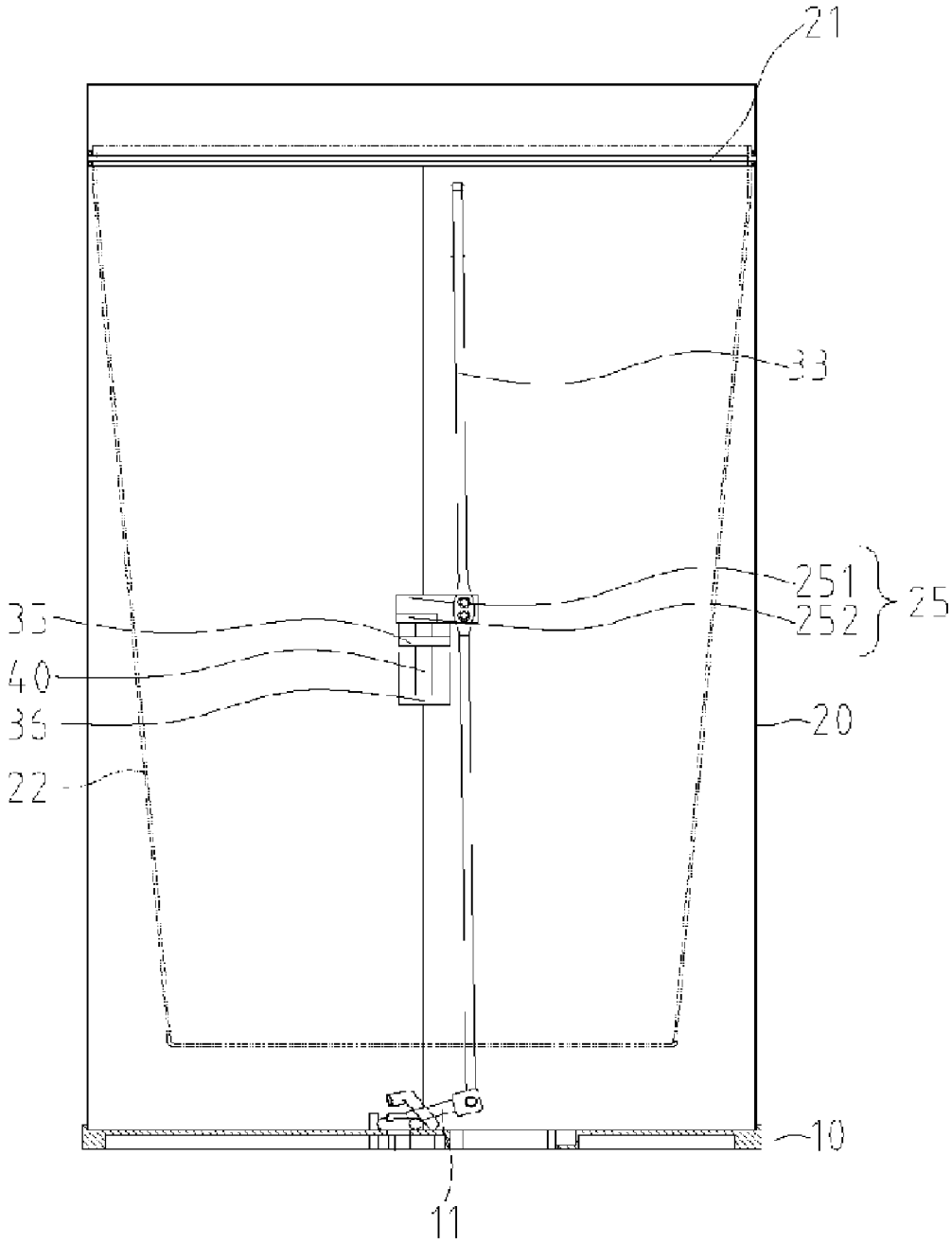
FIG. 9 is a cross-sectional view of the garbage-containing apparatus in another position than shown in FIG. 8.

Referring to FIGS. 4 and 5, the pedal 23 is released to allow the lowering of the cover 30 subject to its own weight. The rod 33 is lowered and so is the mount 34. Hence, the buffer 40 is lowered, and the tongue 41 abuts against the horizontal section 252 of the bracket 25 and is retracted into the buffer 40. By definition, the tongue 41 is retracted into the buffer 40 slowly for buffering the cover 30 through the rod 33 during the lowering stroke.

Referring to FIGS. 6 through 9, there is shown a garbage-containing apparatus according to a second embodiment of the present invention. The second embodiment is like the first embodiment except two things. Firstly, the buffer 40 is attached to the internal side of the metal bin 20 instead of the rod 33. Installing the buffer 40 is done by two mounts 35 and 36. Secondly, the bracket 25 is attached to the rod 33 instead of the internal side of the metal bin 20. The bracket 25 includes a vertical section 251 secured to the rod 33 and a horizontal section 252 for contact with the buffer 40 when the cover 30 is lowered.

The garbage-containing apparatus of the present invention exhibits several advantages. Firstly, it is light in weight, since the buffer adds only a little weight to its total weight. Secondly, it is inexpensive, since the buffer adds only a little cost to the total cost, and it requires little reengineering to incorporate the buffer. Thirdly, it is simple in structure. Fourthly, it is durable, since the buffer is durable. Fifthly, it can be used at a low cost for not requiring intense maintenance.

The present invention has been described through the description of the embodiments. Those skilled in the art can derive variations from the embodiments without departing from the scope of the present invention. Therefore, the embodiments shall not limit the scope of the present invention defined in the claims.

What is claimed is:

1. A garbage-containing apparatus comprising:

a base;

a bin installed on the base;

a cover installed on the bin;

a pedal;

a linking device linking the pedal to the cover, wherein the linking device comprises a crank shaft connected to the pedal and a rod, with the crank shaft including an intermediate portion and first and second legs extending in a non-parallel angle from opposite ends of the intermediate portion, with the pedal secured to the first leg, with the intermediate portion of the crank shaft pivotally mounted relative to the base about the intermediate portion, with the rod having a lower end pivotally connected to the second leg of the crank shaft about a first pivot axis spaced from and parallel to the intermediate portion and an upper end pivotally connected to the cover about a second pivot axis spaced from and parallel to the intermediate portion and the first pivot axis, with the cover being lifted from a closed position to an open position when the pedal is trodden; and a buffering device provided between the rod and the bin for buffering the cover in a lowering stroke of the cover, wherein the buffering device comprises a bracket and a buffer, with the buffer including a housing having an interior and including a tongue extendable from and retractable into the interior of housing, with the bracket connected to one of the bin and the rod with the housing of the buffer connected to another of the bin and the rod, with the interior of the housing spaced from the rod, with the tongue retracted into the housing of the buffer and abutting against the bracket when the cover is in the closed position, with the tongue extending from the housing of the buffer when the cover is in the open position.

2. The garbage-containing apparatus according to claim 1 wherein the tongue is removed from the bracket when the cover is in the open position.

3. The garbage-containing apparatus according to claim 2 wherein the bracket is secured to the bin and the buffer is connected to the rod for buffering the bracket.

4. The garbage-containing apparatus according to claim 3 wherein the bracket comprises a vertical section secured to the bin and a horizontal section secured to the vertical section, with the vertical section being intermediate the bin and the horizontal section, with the tongue abutting against the horizontal section, with the vertical section being intermediate the bin and the tongue.

5. The garbage-containing apparatus according to claim 3 wherein the buffering device comprises a mount for mounting the buffer on the rod.

6. The garbage-containing apparatus according to claim 5 wherein the mount comprises a flat section secured to the rod and a looped section fit on the housing of the buffer, with the looped section being spaced from the rod, with the flat section located intermediate the looped section and the rod.

7. The garbage-containing apparatus according to claim 6 wherein the rod comprises a flat section secured to the flat section of the mount.

8. The garbage-containing apparatus according to claim 2 wherein the bracket is secured to the rod and the buffer is connected to the bin for buffering the bracket.

9. The garbage-containing apparatus according to claim 8 wherein the bracket comprises a vertical section secured to the rod and a horizontal section for abutment against the tongue.

10. The garbage-containing apparatus according to claim 8 wherein the buffering device comprises two mounts for mounting the buffer on the bin.

11. The garbage-containing apparatus according to claim 2 wherein the cover comprises an extension connected to the rod.

12. The garbage-containing apparatus according to claim 2 wherein the bin is made of metal.

13. The garbage-containing apparatus according to claim 12 wherein the cover is made of metal.

14. The garbage-containing apparatus according to claim 12 comprising a plastic bin located in the metal bin so that the plastic bin contains garbage while the metal bin decoratively conceals the plastic bin.

* * * * *